US006390006B1

(12) United States Patent
Sridhar

(10) Patent No.: US 6,390,006 B1
(45) Date of Patent: May 21, 2002

(54) SEA BULK TRANSFER VESSEL

(75) Inventor: Sidney Sridhar, Richmond (CA)

(73) Assignee: Seabulk Systems, Inc., Richmond (CA)

( * ) Notice: Subject to any disclaimer, the term of this patent is extended or adjusted under 35 U.S.C. 154(b) by 0 days.

(21) Appl. No.: 09/484,591

(22) Filed: Jan. 18, 2000

(51) Int. Cl.[7] ..... B63B 25/02; B63B 27/30; B63B 27/22

(52) U.S. Cl. ..... 114/73; 414/137.9; 414/138.6; 414/138.7; 414/139.4; 414/141.8; 414/142.4; 414/142.5

(58) Field of Search ..... 114/73; 414/137.9, 414/138.1, 138.2, 138.3, 138.4, 138.5, 138.6, 138.7, 142.1, 142.2, 142.3, 142.4, 142.5, 143.1, 139.4, 141.8

(56) References Cited

U.S. PATENT DOCUMENTS 3,938,676 A 2/1976 Croese
6,010,295 A 1/2000 Sridhar ..... 414/138.5

*Primary Examiner*—Sherman Basinger
(74) *Attorney, Agent, or Firm*—Paul Smith Intellectual Property Law; Paul Smith

(57) ABSTRACT

A self-loading, self-discharging, bulk cargo transhipper 20 comprising a buoyant vessel 21 capable of receiving water as ballast inside the buoyant vessel 21, a bulk material receiving system 22, a bulk material distribution system 25 and a bulk material holding system 28, which transhipper 20 is a deep sea transhipper for the transfer of bulk cargo between vessels or between a port without deep draft loading facilities and a vessel at sea. The invention also relates to method of material transfer between vessels at sea or between a port without deep draft loading facilities and a vessel at sea.

24 Claims, 10 Drawing Sheets

SEA BULK TRANSFER VESSEL

FIELD OF THE INVENTION

This invention relates to a deep sea transhipper for the transfer of bulk cargo between vessels or between port and a vessel. This invention also relates to a method of material transfer.

BACKGROUND OF THE INVENTION

It is trite that many harbours without deep water docking facilities are either completely excluded from participating in the revenue capable of being generated by bulk material loading, or if not completely excluded, are confronted with diverse costly logistical and environmental concerns. The logistical concerns may include the establishment of deep sea berths, conveyors with offshore tressels and frequent dredging, all with concomitant environmental and noise pollution, disruptions, and installation and maintenance costs.

One solution has been to load cargo onto a shallow draft barge which then travels out to deep water, is moored alongside the cargo ship and then off-loaded. Many barges however lack self off-loading capabilities. Generally, even those barges with self off-loading capabilities have no, or limited means to discharge the material into the cargo holds of a cargo vessel at deep sea.

Moreover, even where a port has deep draft loading facilities, it may not always be possible to berth the deep draft cargo vessel within the reach of the port's loading facilities. A means would then be required to transfer the material from the port to the cargo vessel, such as the rigging of a conveyor and a tressel.

In circumstances such as inclement weather and high energy wave action, the utilization of a barge for deep water loading ma be undesirable or even impossible. The design features of but a few barges would provide sufficient stability in such circumstances for a transfer of the material to the cargo Vessel.

Again, few barges, if any, comply with international standards requirements for deep water vessels, such as lop relating to self-sealing bulkheads. Generally, the design specification of barges exclude such features, as their hoppers extend into the bulkheads.

It is an object of the present invention to alleviate the abovementioned difficulties and to provide a transhipper which is capable of being employed not only as a port to ship transhipper, but also as a deep sea, port to ship or even ship to ship transhipper.

SUMMARY OF THE INVENTION

According to the invention there is provided a self-loading, self-discharging, bulk cargo transhipper which comprises of a buoyant vessel, bulk material receiving system, a bulk material distribution system and a bulk material holding system.

The transhipper may be towable by another vessel such as a tug, or it may be equipped with self-propelling and steering means.

The buoyant vessel, which provides a platform for the material receiving system, the material distribution system and the material holding system, may also make provision for one or more ballast chambers for receiving water as ballast inside the buoyant vessel. The buoyant vessel may also provide for hydraulic, electrical and generator rooms to house operating equipment, and it may also allow for crew quarters and an operator's cabin.

According to the invention the material receiving system may comprise of a listing conveyor, comprising a pocket transfer conveyor and, a sea marine leg, for raising material to be unloaded from an outward source, such as a barge, to the transhipper, and a means for slewing or luffing the lifting conveyor relative to the outward source to be unloaded. The material receiving system further comprise; of a hopper, which may be mounted on the bow of the transhipper, and which serves to receive material raised to the transhipper by the lifting conveyor, or which may serve to receive material delivered to the transhipper direct from an outward source, the latter which may be a port or cargo vessel. The said bow hopper is configured to allow for the gravity discharge of the material, received from the outward source direct or raised by the lifting conveyor and discharged into the bow hopper, through a discharge opening onto a loading conveyor means for further conveyance of the material to the material distribution system of the transhipper.

According to the invention, the material distribution system of the transhipper comprises a reclaim conveyor, a C-loop vertical conveyor, a distribution conveyor and a distribution boom, the latter which is supported on a support tower. The reclaim conveyor is the means by which material discharged from the material receiving system is transferred to the vertical conveyor of the material distribution system. The material is raised by the vertical conveyor to the distribution conveyor from whence it is conveyed for discharge to an outward destination, for example, a cargo vessel, or for discharge directly into the material holding system of the transhipper.

The material distribution system of the transhipper also allows for a means whereby the boom of the material distribution system is capable of luffing and slewing to facilitate distribution of the material relative to the position and height of the outward material destination. The material distribution system of the transhipper may also provide for a shuttle means to extend the horizontal reach of the boom conveyor.

Further, according to the invention, the material holding system of the transhipper comprises of a main hopper, longitudinally affixed to the buoyant vessel in a raised position by means of pillars or columns, for the holding of material which is to be transferred to the outward material destination. The main hopper of the material holding system of the transhipper is also configured to allow for the gravity discharge of material through a number of discharge openings onto the reclaim conveyor. The main hopper also comprises a means to control the flow of the material through the discharge openings of the main hopper. In an elaboration of the invention, the main hopper of the material holding system of the transhipper is divided into a plurality of holds, for example, to provide for the segregation of material in separate holds according to, for example, type or weight In a further elaboration of the invention, the material distribution system of the transhipper may also comprise a reversible tripper conveyor, mounted longitudinally above the main hopper of the transhipper, to receive material discharged by the boom conveyor of the material distribution system for further distribution of the material by the tripper conveyor into the said holds of the main hopper.

According to the invention there is also provided a method to transfer material from an outward material source to an outward material destination and a further method to provide a self-loading, self-discharging, deep sea vessel for the transfer of cargo from an outward material source to an outward material destination, the latter which may be at deep sea.

The first said method of operation comprises of the steps of securing the bow of the transhipper to the outward material source and securing the stern of the transhipper to the outward material destination, which may be a cargo vessel. The material from the outward source is discharged directly into the bow hopper of the transhipper or collected by the lifting conveyor of the transhipper and discharged into the bow hopper. The material is discharged from the bow hopper onto a loading conveyor by which it is conveyed to, and discharged onto the reclaim conveyor which, in turn, transfers the material to the vertical Conveyor. The material is raised by the vertical conveyor and discharged onto the boom conveyor of the distribution boom, which is slewed over the cargo hold of the outward material destination. The material is then discharged into the said cargo hold from the boom conveyor.

Further according to the invention, a second method of operation is provided comprising the steps of directly receiving or collecting material from an outward source as described in the first method above. The material so received by the material receiving system of the transhipper is discharged onto the reclaim conveyor, raised by the vertical conveyor and discharged onto the boom conveyor. The material discharged onto the boom conveyor is, in turn, discharged directly into the main hopper of the transhipper or onto the reversible tripper conveyor for further distribution into the holds of the main hopper of the transhipper. The material is held in the main hopper of the transhipper whilst the transhipper is towed, or whilst it propels itself to the outward material destination. Having reached the outward destination, which may be a cargo vessel, the transhipper is moored alongside the cargo hold of the cargo vessel. In a further elaboration of this method, the transhipper may be moored diagonally to cargo hold of the cargo vessel with the stern of the transhipper facing the cargo vessel. In either case, the boom of the material distribution system of the transhipper is slewed over the cargo hold of the cargo vessel. The material held in the main hopper of the transhipper is then discharged onto the reclaim conveyor through the discharge openings of the main hopper of the transhipper. The material is then transferred to the vertical conveyor of the transhipper, raised and discharged onto the boom conveyor. The material is then discharged by the boom conveyor into the cargo hold of the cargo Vessel.

Further objects and advantages of the invention will become apparent from the description of the preferred embodiment of the invention below.

BRIEF DESCRIPTION OF THE DRAWINGS

The invention is now described with reference to the accompanying drawings, in which.

DETAILED DESCRIPTION OF THE PREFERRED EMBODIMENT

Figure 1:
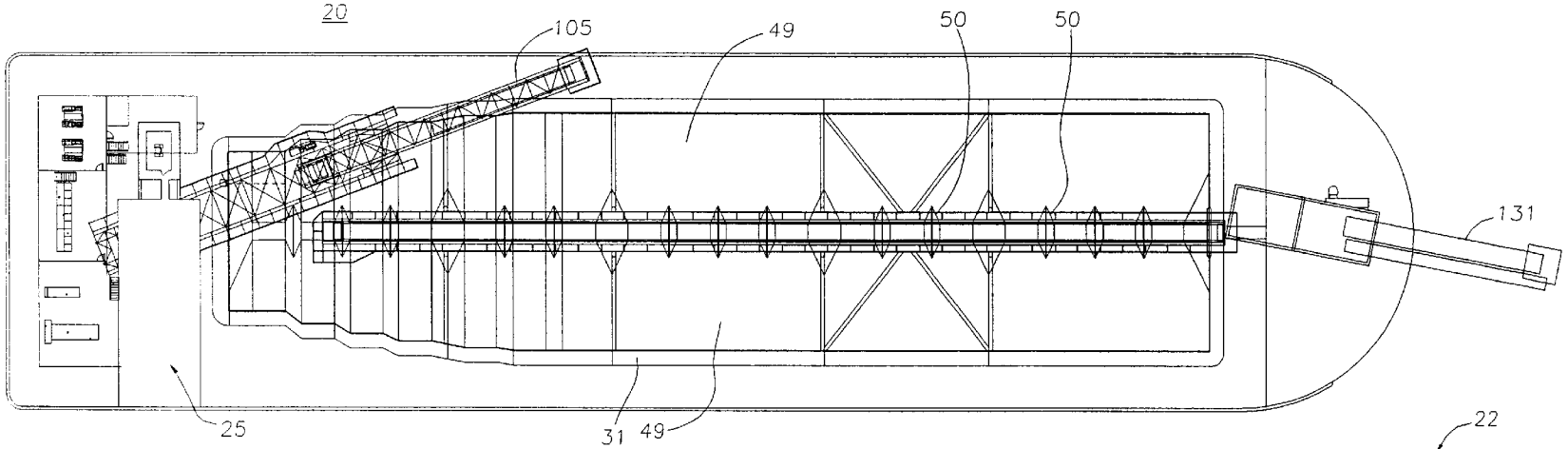
FIG. 1 is a plan view of a transhipper according to the invention.
Figure 2:
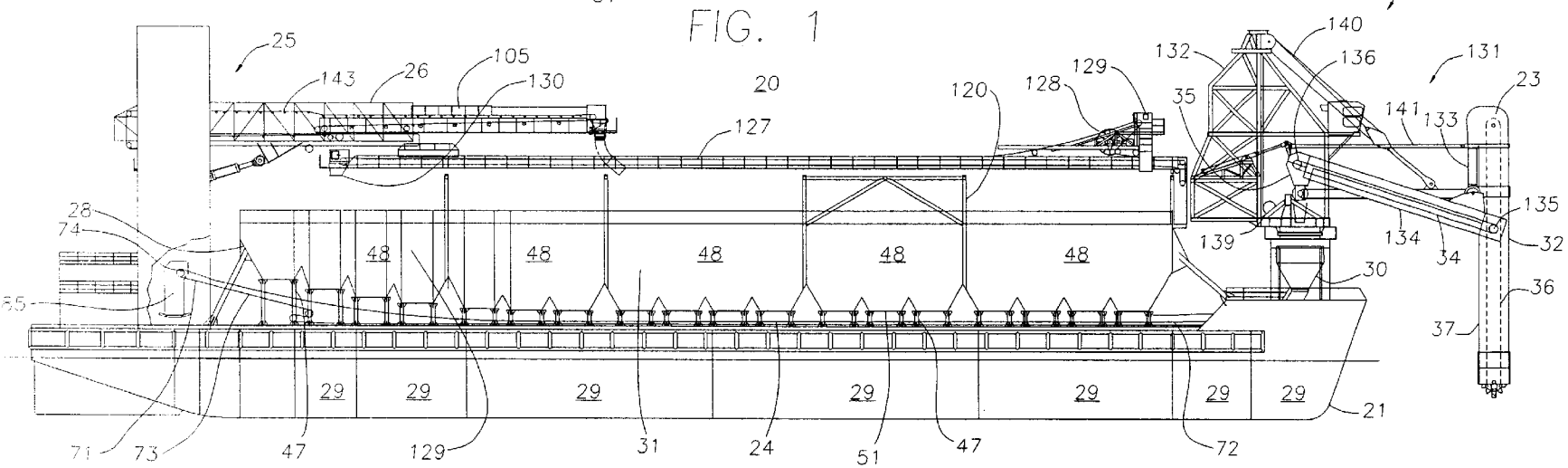
FIG. 2 is a sectional side elevation of the transhipper of FIG. 1.

The transhipper shown in FIGS. 1 and 2, generally indicated by numeral 20, comprises:

a buoyant vessel 21;

a bulk material receiving system 22;

a bulk material distribution system 25; and a bulk material holding system 28.

The buoyant vessel 21 is hollow member and defines a chamber or a plurality of chambers 29 for receiving water as ballast inside the buoyant vessel. The extent of the chambers 29 is indicated by the crosslines in the drawings. Sea inlet and outlet openings are provided in the chambers 29 to provide an entry for ballast water into the chambers. The inlet openings are closed by any suitable valve means when the required amount of ballast water has been permitted to flow into the chambers 29. Pumps are provided for pumping ballast water out of the chambers through the outlet openings. Further openings may be provided to permit the discharge of air from the ballast chambers 29 or the introduction of compressed air into the chambers, for example, to force water out of the ballast chambers.

The material receiving system 22 comprises a lifting conveyor means 23, a bow hopper 30, loading conveyor 131 and a support tower 132.

The lifting conveyor means 23 comprises a sea marine leg 32 for raising material from an outward source, a pocket belt transfer conveyor 34 and a chute 35 to receive the material discharged by the pocket belt transfer conveyor 34 and to direct the discharged material into the bow hopper 30.

The sea marine leg 32 comprises a bucket elevator or conveyor 36 housed in a casing 37 and a discharge chute 133. The bucket conveyor 36 comprises a pair of laterally spaced endless chains 40 mounted for rotation about sprockets 41 and 42, with sprocket 42 located vertically above sprocket 41. Each of the sprockets 41 and 42 comprises a pair of laterally spaced toothed wheels for engaging with chains 40.

Figure 8:
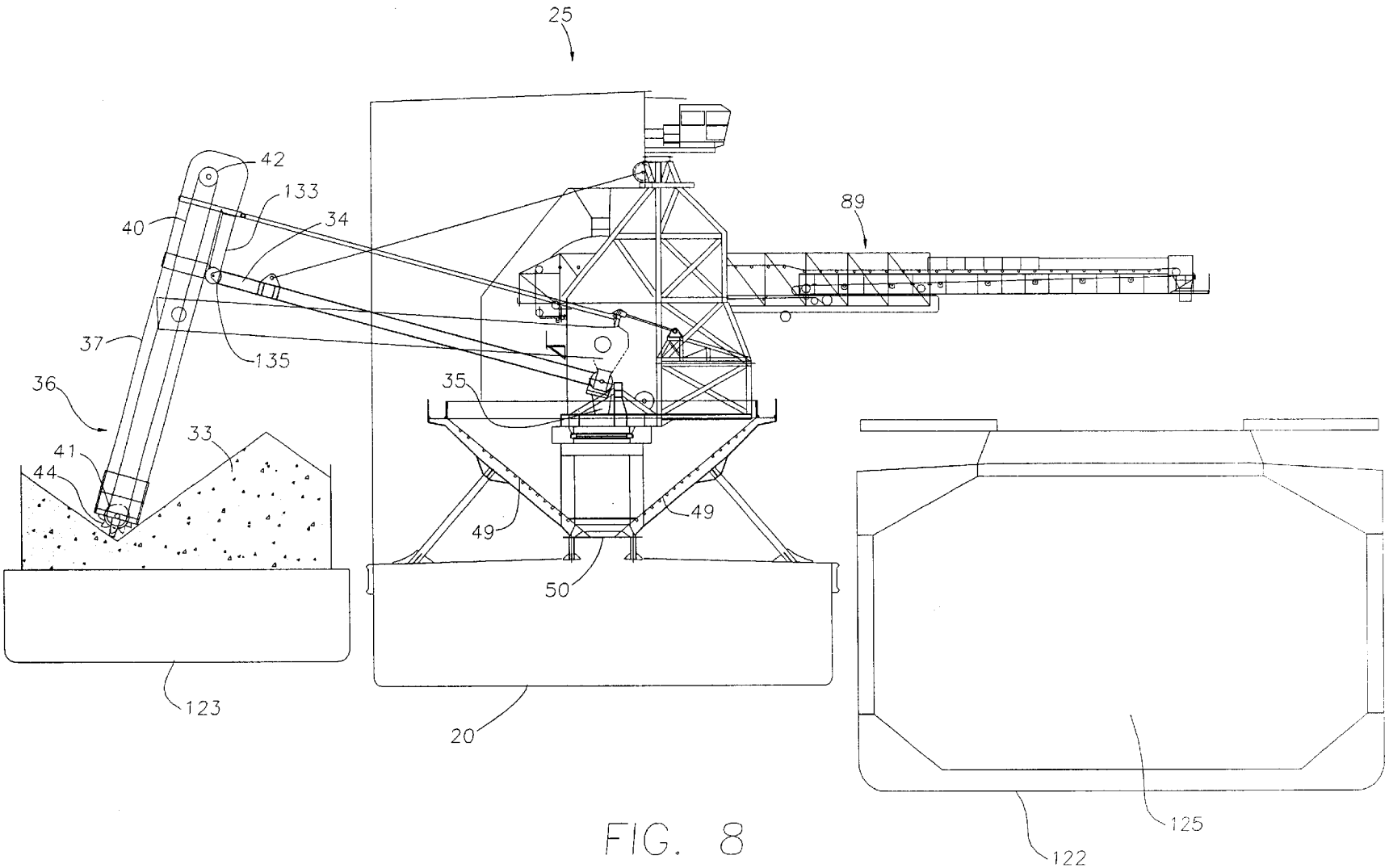
FIG. 8 is a section of the transhipper at baseline 170 in FIG. 2 showing the transhipper of FIG. 1 moored between an outward material source and an outward Material destination, showing a method of a self-loading of the material by the transhipper and the discharge of the material to the outward material destination.

As shown in FIG. 8, a plurality of buckets 44 are mounted between the chains 40. Each bucket is mounted to the chains by means of a pair of shafts, each shaft being common to a pair of laterally adjacent buckets 44.

The buckets 44 are of steel and each may be provided with an abrasion resistant digging edge which may comprise a steel blade or a set of teeth as is desired.

The buckets are fixed to the chains 40 so that they will scoop up materials from the outward material source 33 when travelling around the lower sprocket 42. The material is retained in the bucket 44 whilst being rotated to the upper sprocket 41 and the material is discharged by the inversion of the bucket 44 when it passes around the upper sprocket 41.

The discharge chute 133 of the sea marine leg 32 is located to receive the material discharged from the buckets 44 when the buckets 44 rotate around sprocket 41. The material is directed through the said chute 133 onto the pocket belt transfer conveyor 34.

The pocket belt transfer conveyor 34 is encased in a frame 134 comprising horizontal and vertical longitudinal and transverse stiffening members. The frame 134 is pivotally connected at both ends to allow vertical height adjustment of the sea marine leg 32 in relation to the material to be unloaded from the outward material source. The head end 135 of the frame 134 is pivotally connected to the caging 37 of the sea marine leg 32 underneath the sea marine leg discharge chute 133, and the tail end 136 is pivotally connected to the support tower 132 where the material is discharged from he pocket belt transfer conveyor 34 into chute 35 through which tail end 136 and chute 35 are supported above the bow hopper 30 by the support tower 132 in a raised position to allow for the discharge of the material into the bow hopper 30.

The super structure 139 of the support tower 132 is mounted in a raised position on a number of columns or pillars above the bow hopper 30 and is capable of swivelling movement to allow a horizontal slewing of the lifting conveyor 23 relative to the position of the outward material source to be off loaded.

The pocket belt transfer conveyor frame 134 is further provided with a wire rope tackle means 140 to vertically raise or lower the frame front end 135 relative the frame tail end 136, which in turn raises or lowers the sea marine leg 32 relative to the material source.

The lifting conveyor 23 further comprises a kicking arm arrangement 141, powered by a hydraulic cylinder, and pivotally attached at the one end to the casing 37 of the sea marine leg 32 and pivotally attached at the other end to the supported tower 132 to allow luffing of the sea marine leg 32.

The side walls of the bow hopper 30 are directed towards the interior to converge at a discharge opening at the lower end of the hopper 30 to facilitate gravity discharge of the material from the bow hopper 30 onto the loading conveyor 131 positioned below the discharge opening of the bow hopper 30.

The bow hopper 30 is mounted above the buoyant vessel 21 in a raised position to facilitate the discharge of material from the bow hopper 30 to the loading conveyor 131 below.

The loading conveyor 131 comprises an endless belt rotated around end rollers, the loading surface of the loading conveyor 131 being supported by idler rollers. The loading conveyor 131 is longitudinally supported on the buoyant vessel 21 in a raised position between the reclaim conveyor 24 and the bow hopper to allow for a discharge of the material discharged onto the loading conveyor 131 from the bow hopper 30, onto the reclaim conveyor 24.

The material holding system 28 of the transhipper comprises a main hopper 31 disposed longitudinally on the buoyant vessel 21 and supported in a raised position by a plurality of columns 47.

The main hopper 31 may be divided into a plurality of inline storage holds 48 to allow for a segregation of materials of different types and weights. The side walls 49 of the main hopper 31 and inline storage holds 48 are directed toward the interior of the hold 48 to converge at a discharge opening 50 or a plurality of discharge openings 50 at the lower end of the hold 48 to facilitate gravity discharge of the material from the hold 48.

Figure 5:
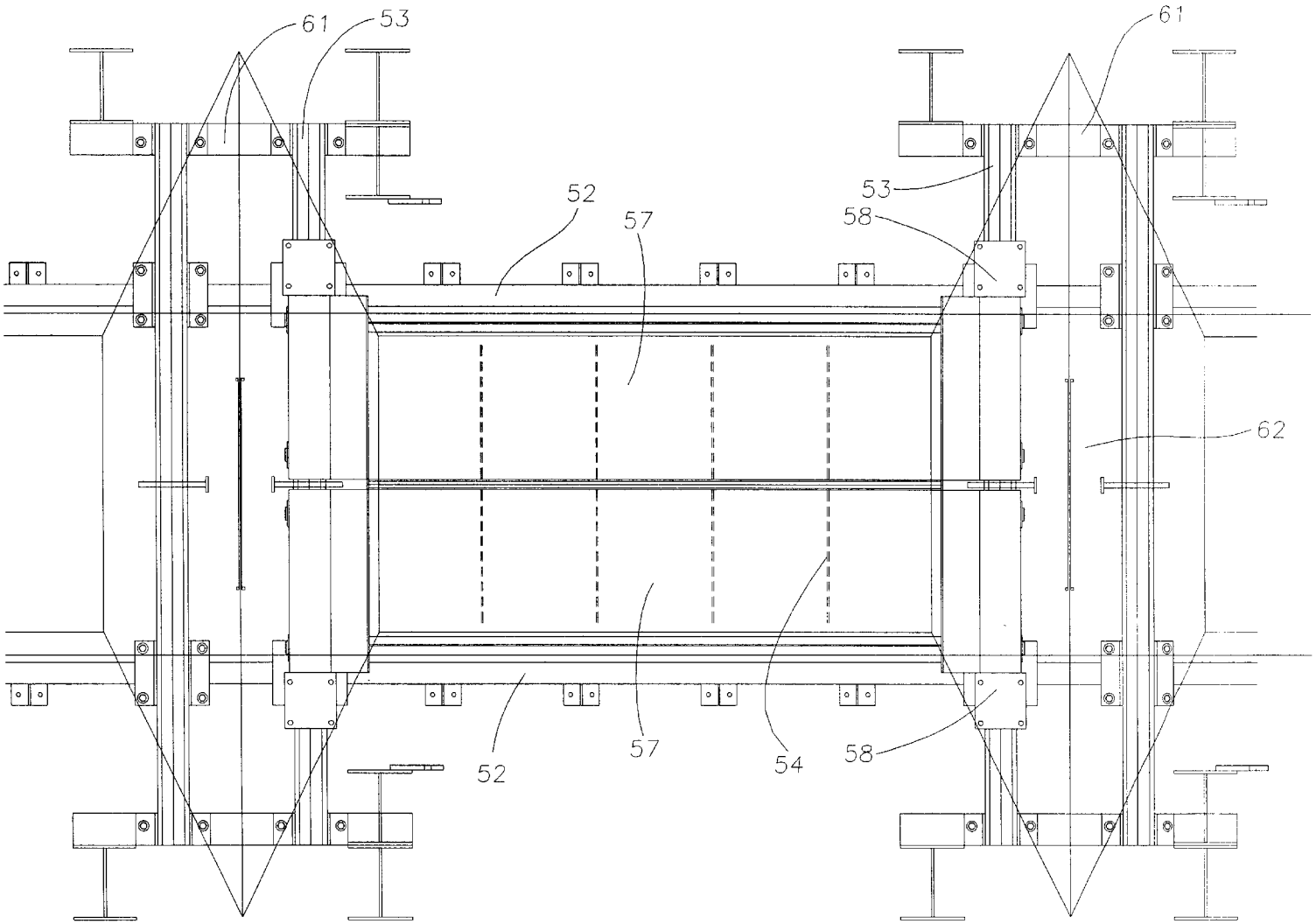
FIG. 5 is a plan view of a gate of the main hopper of the transhipper of FIG. 2.
Figure 6:
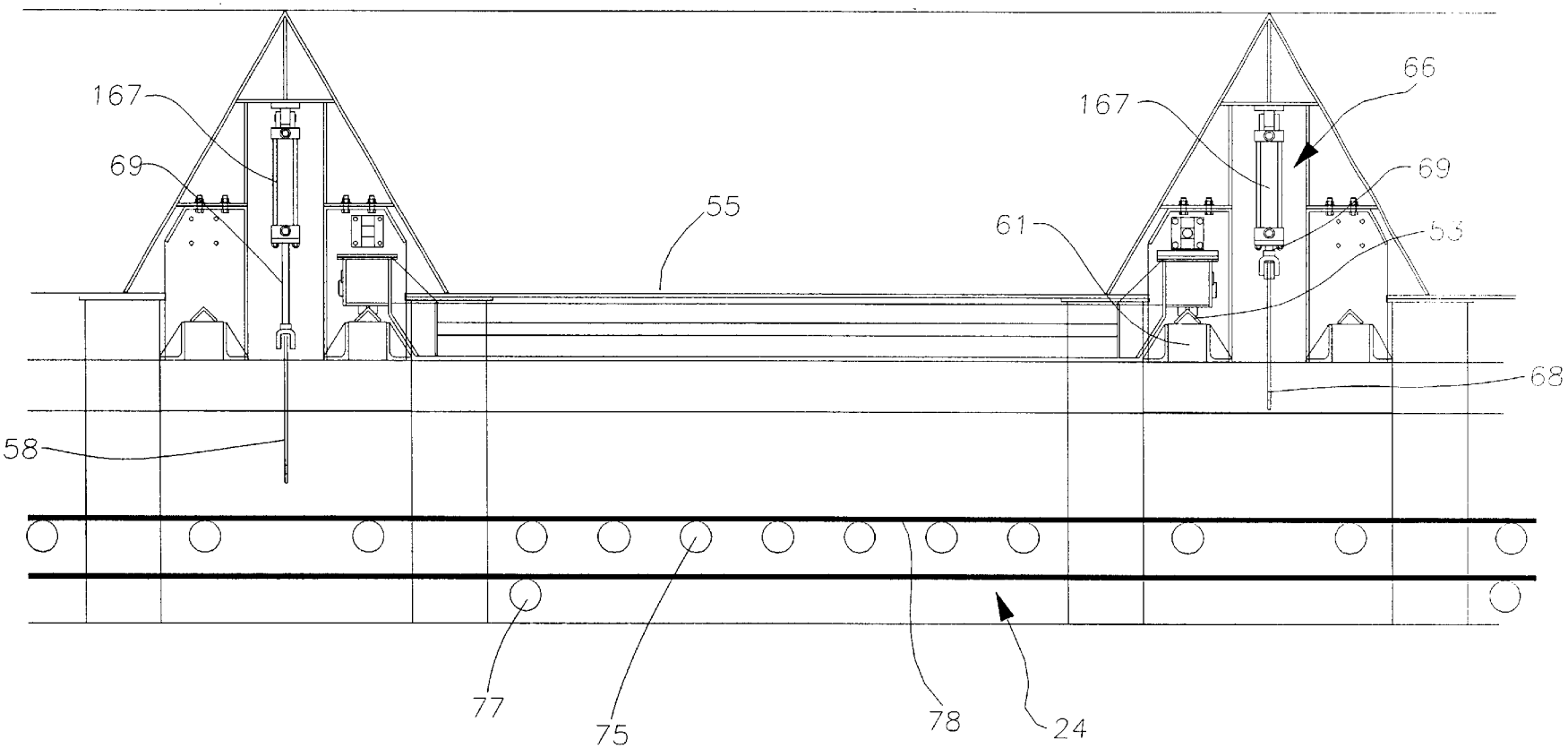
FIG. 6 is a plan view of the gate of FIG. 5.

The main hopper 31 further comprises a gate 51 for each discharge opening 50 with a pair of opposing closure members 57 for each gate 51. As shown in FIG. 5, each gate 51 is supported on an elongated framework comprising of longitudinal framework members 52 and transverse framework members 61. The framework 52 and 61 is supported in a raised position above the buoyant vessel 21 by means of a plurality of support columns 58. The transverse framework 61 of the gate 51 is provided with two opposed transverse tracks 53, disposed on both sides of the discharge opening 50 as shown in FIG. 5, Each closure member 57 has a plurality of wheels 56 for running along tracks 53.

The closure members 57 of each gate 51 are movable on the track 53 in a transverse direction relative to the discharge opening 50. Each closure member 57 is provided with longitudinal and transverse stiffening members 54 and each closure member 57 is encased by cover plates 55.

The transverse movement of each of the closure members 57 in either direction is effected by means of a pair of hydraulic cylinders 67 located on opposite, longitudinal ends of each of the closure members 57. The cylinders 59 are at the one end connected to the closure member 57 and at the other end fixedly attached to the gate transverse framework 61, at point 62 on the transverse framework 61 of the gate 51, equidistant between the longitudinal elongate frameworks 52 of the gate 51 as shown in FIG. 5.

The transverse movement of each of the closure members 57 allow for a variable stroke to determine the volume and rate of discharge of material from the main hopper 31 or each of the main hopper holds 48.

Through a variable, lateral orientation of each of the two opposing closure members 57 in the gate 51 in opposite directions, the rate of discharge of the material from the main hopper 31 or a main hopper hold 48 through the discharge opening 50 and the skirt opening 59 onto the reclaim conveyor 24 is achieved, the rate of discharge achieved being relative to the extent of the lateral orientation of each closure member 57 in an opposite direction to the other closure member 57 and the speed of rotation of the reclaim conveyor 24.

Each gate 51 further comprises a skirt opening 59 underneath the opposing closure members 57 of each gate 51. The skirt opening 59 is defined longitudinally by the skirting plates 6A which are fixedly attached, by means of a skirting bracket 64, to an idler support beam 65. The skirting plate 63 spans the distance between the longitudinal ends of the main hopper 31 on opposing sides of the skirt opening 59 to form a barrier to counteract a material overflow from the reclaim conveyor 24.

The transverse and longitudinal frameworks of each gate may incorporate means to allow for the adjustment of the height, level and field of each track 53.

Each gate 51 of the main hopper 31 also comprises a shear gate system 66 fixedly mounted to the main hopper 31 between each gate 51. The shear gate system 66 comprises an hydraulic cylinder 167 and a shear plate 68. The shear plate 68 is removably attached to the plunger 69 of the cylinder 167 to facilitate removal and replacement of the shear plate 68 as is desired. The shear plate 68 is positioned transverse to the reclaim conveyor 24. The shear gate system 66 is positioned to allow for a variable, vertical stroke extending the shear plate into the skirt opening to determine the height of the material on the reclaim conveyor 24. The shear gate system 66 is further provided with a shear plate track 70 to slidably attach both vertical sides of he shear plate 68 to the skirting plates 63 to prohibit lateral movement of the shear plate during Operation of the reclaim conveyor 24. Jointly therefore, the skirting plates 63 and the shear plates 68 define the volume of material conveyed on the reclaim conveyor 24.

The material distribution system 25 of the invention comprises of a reclaim conveyor 24, a C-loop vertical conveyor 86, a boom 89 supported on a support tower 96 and a boom conveyor 26.

The reclaim conveyor 24 of the material distribution system 25 spans the length of the buoyant vessel 21 between the material receiving system 22 and the vertical conveyor 86. The reclaim conveyor 24 is suspended in a raised position underneath the gates 51 of the main hopper 31 and 24 comprises a head end 71, a tail end 72 and an endless belt 73 rotated around spaced rollers 74. The material bearing surface 78 of the endless belt 73 is supported by a number of spaced carrying idler rollers 75 and the return belt of the endless belt 73 is supported by a number of return idler rollers 76. Underneath each gate, the material bearing surface 78 of the endless belt 73 is supported by a number of closely spaced impact idler rollers 77.

Figure 7:
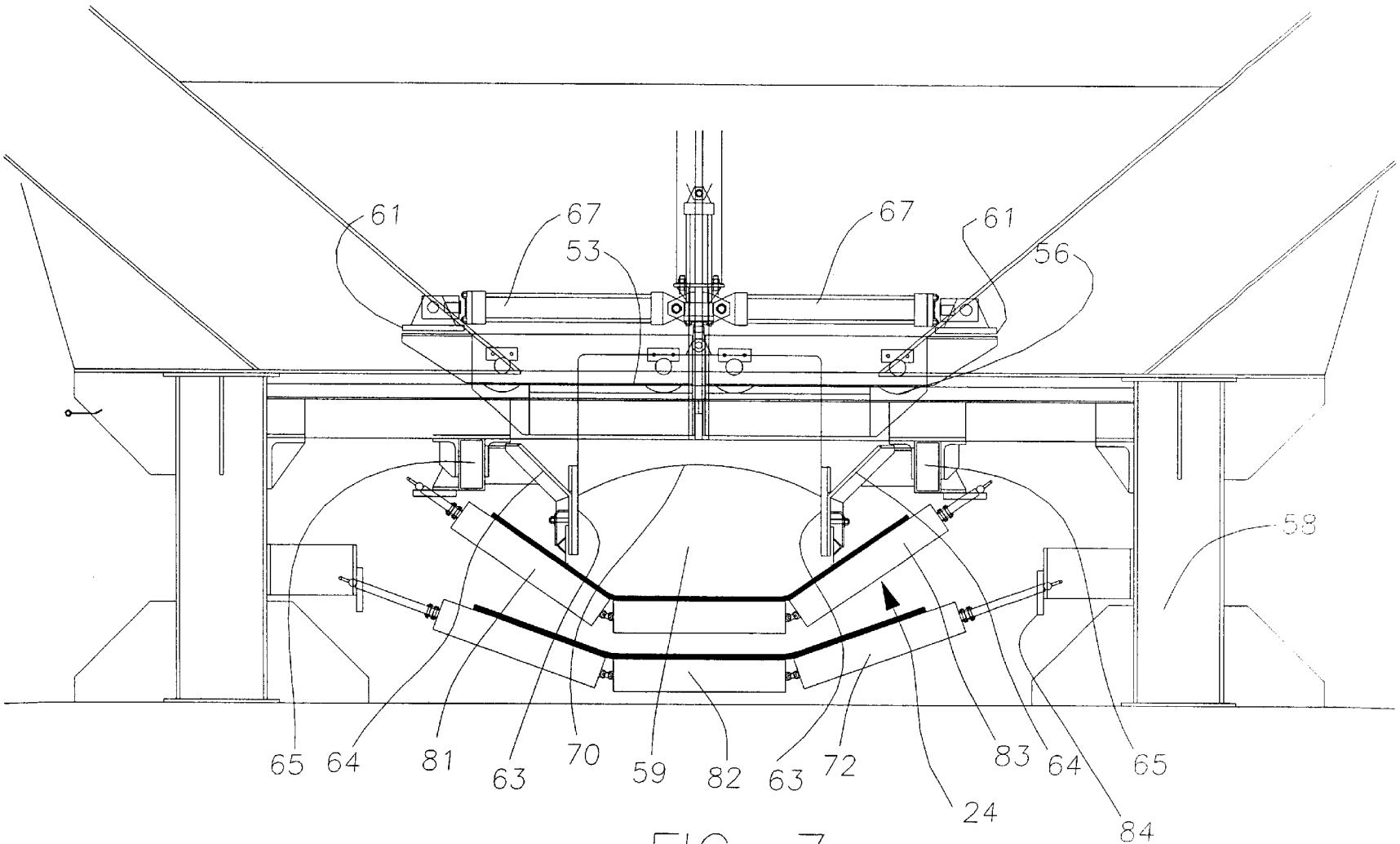
FIG. 7 is a section of the gate of FIG. 6 at lines I to II.

Each carrying idler roller 75 may be configured to comprise three inline carrying idler rollers, the shaft of each idler roller connected to the shaft of the other, with the outside shafts of the first and third idler rollers attached by means of a carrying idler suspender bracket 82 to the laterally opposing idler roller support beams 65. As shown in FIG. 7, the second idler roller 82 is suspended at a lower elevation than the first idler roller 81 and the third idler roller 83 to provide a cradle to facilitate containment of the material on the reclaim conveyor 24. According to the invention, the impact idler rollers 77 may also be attached .and configured as described above, save that the impact idler rollers 77 are attached to a gate bracket column 58 by means of a return idler suspender bracket 84.

Material discharged onto the reclaim conveyor 24 tail end 72 by the material receiving system 22, as well as the material discharged onto the reclaim conveyor 24 from the main hopper 31, is conveyed to the head end 71 of the reclaim conveyor 24. At the head end 71 of the reclaim conveyor 24 the material is discharged into a discharge chute 85 which is affixed to the buoyant vessel 21 in a raised position by means of pillars to facilitate a discharge of the material onto the tail end 100 of the primary conveyor belt 92 of the C-loop vertical conveyor 86 described below.

According to the preferred embodiment of the invention, the head end 71 of the reclaim conveyor 24 is, as shown in FIG. 2, from frame spacing numbers 60 In FIG. 2, vertically inclined to compensate for the elevated positioning of the head end discharge chute 85 of the vertical conveyor 86. The floors of the main hopper hold, in order to accommodate the elevation of the head end 71 of the reclaim conveyor 24 as described, are compensationally inclined.

According to the invention the C-loop vertical conveyor 86 of the bulk material distribution system 25 of the transhipper 21 comprises a discharge chute 85 at the reclaim conveyor 24 head end 71, a dual, endless belt vertical conveyor 86 encased in a C-loop tower 87, a head end discharge chute 88, a telescopic, horizontal boom 89 comprising a telescopic boom conveyor 26 and a support tower 96.

The C-loop vertical conveyor 86 may be oriented in a position perpendicular to the reclaim conveyor 24.

Figure 4:
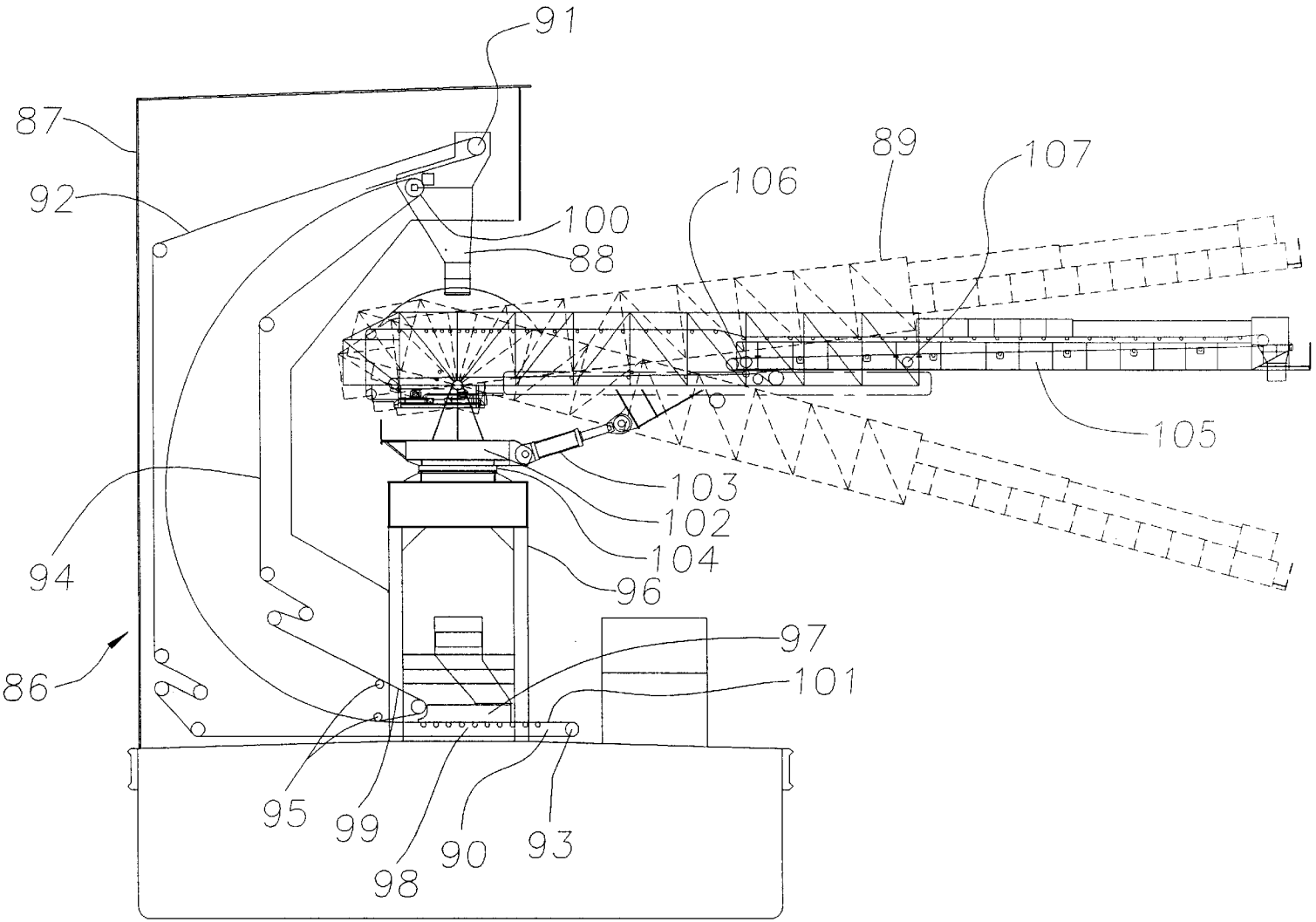
FIG. 4 is a section of the transhipper at baseline 30 in FIG. 2.

As shown in FIG. 4, the vertical conveyor 86 comprises a primary conveyor belt 92 and a secondary conveyor belt 94. The primary conveyor belt 92 comprises a head end 90, a tail end 91, an endless belt rotated around a pair of spaced rollers 93, spaced carrying idler rollers positioned to support the material bearing surface 97 of the primary conveyor belt 92, spaced return idler rollers and spaced impact idler rollers 98 positioned underneath the discharge chute 85. The secondary conveyor belt 94 of the elevating conveyor 86 also comprises of a head end 99, a tail end 100, an endless belt rotated around a pair of spaced idler rollers 95, spaced carrying idler rollers to support the material bearing surface 97 of the endless belt and spaced return idler rollers.

As shown in FIG. 4, the C-loop vertical conveyor 86 is disposed to describe a half circle wherein the said head ends 90 and 99 and tail ends 91 and 100 of primary 92 and secondary conveyor belts 94 represent the diameter of the half circle and where the head ends 90 and 99 are elevated vertically above the tail ends 91 and 100. Further, as described above, the carrying idler rollers of the primary 92 and secondary belts 94 may comprise three, inline idler rollers, also connectably positioned to provide a cradle as described above to facilitate the containment of the material conveyed between the respective material bearing surfaces 97 of the primary 92 and secondary 94 conveyor belts. Further according to the preferred embodiment of the invention, the material bearing surface 97 of the secondary conveyor belt 94 is introduced in a closed, inversely opposed position to the material bearing surface 97 of the primary conveyor belt 92 so that the respective material bearing surfaces 97 of the primary 92 and secondary 94 belts define a tunnel to enclose and contain, or "sandwich", the material raised in the vertical conveyor 86 to the C-loop discharge chute 88. In this preferred embodiment of the invention, the edges of the primary 92 and secondary 94 belts meet to provide a seal to counteract leaking of the material from the belts during the elevation of the material.

Further, as shown in FIG. 4, the head end 90 of the primary belt 92 extends beyond the head end 99 of the secondary belt 94 to present a material receiving surface 101 for the material discharged from the discharge chute 85. Again, at the tail end 91 of the primary belt 92, the tail end 100 of the secondary belt 94 is overlapped by the primary belt 92 to facilitate release and discharge of the raised material into the head end discharge chute 88.

According to the preferred embodiment of the invention, the vertical conveyor 86 is encased in a tower 87 to provide a support means for the elevating conveyor 86.

The material raised in the vertical conveyor 86 is fed through the head end discharge chute 88 to the boom conveyor 89. The boom 89 is pivotally supported on a support member 102 to permit horizontal luffing of the boom by means of a luffing cylinder assembly 103. The luffing cylinder assembly 103 is operatively connected between the boom 89 and the support member 102 for effecting the luffing motion. The support member 102 is in turn swivelably attached to the support tower 96 by means of a slewing bearing 104 to permit rotation of the boom 89 about a vertical axis for effecting the slewing of the boom 89 forward and astern of the buoyant vessel 21.

In order to extend the longitudinal reach of the boom 89, it is provided with a boom shuttle 105 which is mounted for longitudinal movement relative to the boom 89. The shuttle 105 is movably supported in the boom 89 by two sets of shuttle wheels 106 and 107, The wheels 106 are at the tail end of the shuttle 105 and the wheels 107 are spaced from wheels 106 towards the middle of the shuttle 105. The wheels 106 and 107 are supported between two wheel tracks fixedly attached to the boom 89. The tracks maintain the shuttle 105 in a cantilevered position whilst the shuttle is extended or retracted. Stops are provided at opposite extremes of the tracks to prevent an overrun by the wheels 106 and 107 during extension and retraction of the shuttle 105.

Figure 3:
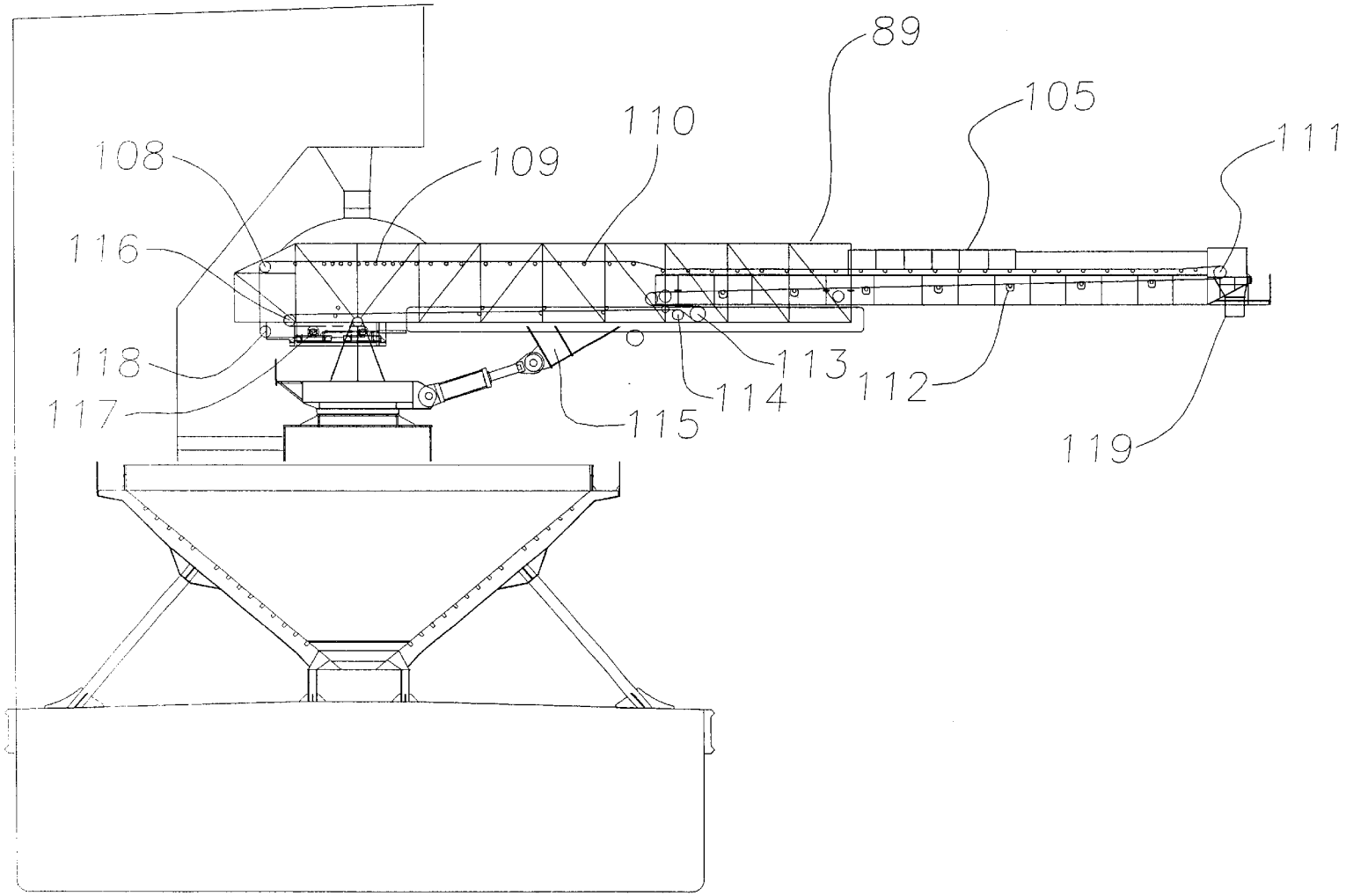
FIG. 3 is a section of the transhipper at baseline 65 in FIG. 2.

The boom 105 includes a conveyor 26 in the form of an endless belt 143 rotated around a multiplicity of spaced rollers. As can be seen in FIG. 3, the belt 143 extends from the first tail end roller 108 over a multiplicity of impact idler rollers 109 and carrying idler rollers 110 extending along the boom 89 and shuttle 105. The belt then extends around a head roller 111 and along a number of return idler rollers 112 to an end roller 113 attached to the rear end of the shuttle 105. The belt then extends around an end roller 113 attached to the boom 89 and a take up roller 114, and along a number of return idler rollers 115 to an end roller 116. From the end roller 116 the belt passes around a drive roller 117 and a second tail end snub roller 118 to increase the wrap of the belt around the drive roller 117, from where the belt passes back to the first tail end roller 108.

It can be seen that the length of the belt is automatically adjusted as the shuttle 105 moves relative to the boom 89 by virtue of the fact that the belt passes around roller 113 affixed to the rear end of the shuttle 105.

In use, material is discharged from the chute 88 onto the boom conveyor 26 above the impact idler rollers 109 at the tail and of the boom 89. The material is conveyed to the front end of the shuttle 105 where it is discharged into a chute 119 for distribution outward of the buoyant vessel 21 or distribution to the main hopper 31 of the buoyant vessel 21.

According to the preferred embodiment of the transhipper there is also provided a tripper conveyor 27 supported in a raised position above the main hopper 31 by a plurality of pillars 120. The tripper conveyor 27 extends longitudinally above the main hopper 31 along the equidistant line as shown in FIG. 1.

Further according to the preferred embodiment of the transhipper 20, it is provided with electronic means for synchronising the respective rotating speeds of the conveyor belts, pocket belt conveyor and bucket conveyor.

OPERATION

In the first method of the operation of the preferred embodiment of the invention, the transhipper 20 is moored, as shown in FIG. 8 between a cargo vessel 122 and a barge 123.

The Marine leg 32 is lowered into the cargo on the barge 123. In the example of FIG. 8, the cargo is particulate or granular material. When the buckets 44 reach the material, the material is scooped up by the buckets 44 successively digging into the material as they are rotated around the sprockets 41 and 42. The sea marine leg 32 may further comprise a mechanism for sensing the load of the marine leg motor to control the load of the buckets 44 and a compensating mechanism to provide for compensation of distance variations between the transhipper 20 and the barge 123 which may result from wave action during operation. Both said mechanisms are described in U.S. Pat. No. 6,010,295, the contents of which is incorporated herein by reference.

The material scooped up by the bucket 44, as the buckets rotate around sprocket 41, is raised and rotated around sprocket 42 and inverted so that the material is discharged from the inverted buckets 44 onto the transit conveyor 34. The material is discharged into chute 35 which empties into bow hopper 23, is in turn discharged through bow hopper 23 onto the bow hopper loading conveyor 124 and deposited by the said conveyor 124 onto the tail end 72 of the reclaim conveyor 24. The material is conveyed by the reclaim conveyor to the vertical conveyor 86 where it is deposited into chute 85. The material is then discharged onto the tail end 90 of the primary belt 92 of the elevating conveyor 86, "sandwiched" between the respective material bearing surfaces 97 of the primary 92 and secondary 94 belts, raised to the respective tail ends 91 and 100 of the primary 92 and secondary 94 belts and discharged into chute 88. The material passes through chute 88, is deposited onto the boom conveyor 26 of the boom 89 and discharged through chute 119 into the cargo hold 125 of cargo vessel 122.

In the first method of operation, the transhipper 20 may be employed to transfer material as described either in a port or at open sea.

Figure 10:
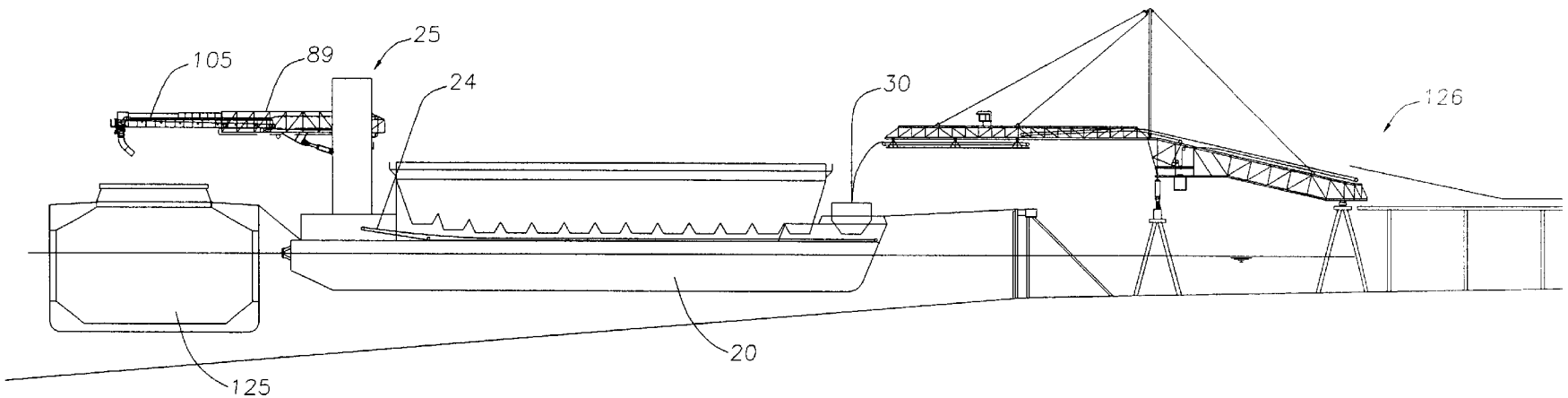
FIG. 10 is a side view of the transhipper of FIG. 1 showing a method of material transfer where the transhipper is moored between an outward material source and an outward material destination and where the transhipper acts as a long reach bridge for the transfer of materials between the said source and destination.
Figure 11:
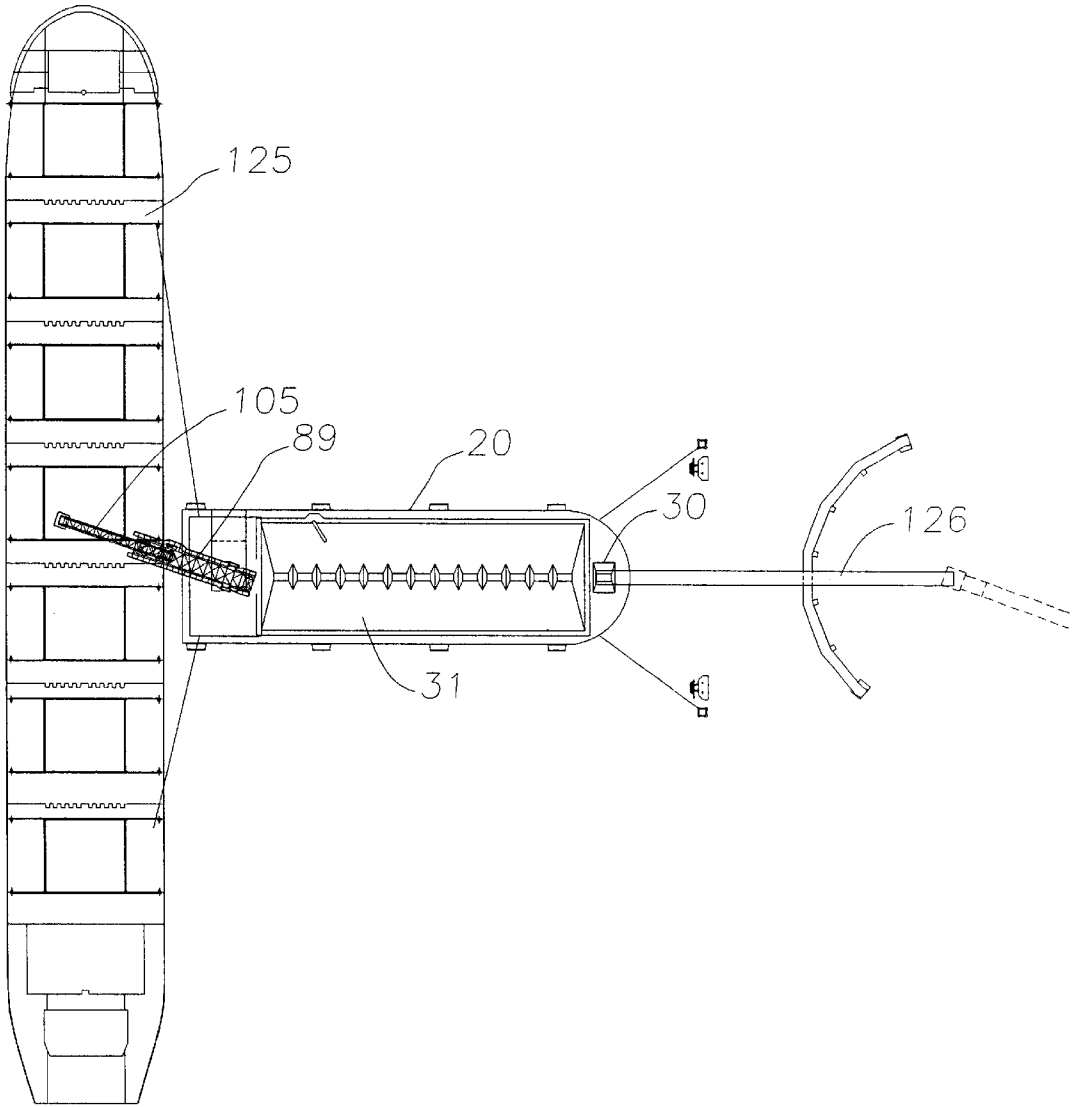
FIG. 11 is a plan view of the method of FIG. 10 showing a transfer of material from an outward material source to an outward material destination using the transhipper of FIG. 1 as a long reach bridge.

In the second method of operation, the transhipper 20 is moored, as shown in FIGS. 10 and 11, to transfer material from an outward source without close, deep draught facilities 126 to a deep draught cargo vessel 125. In this mode of operation, the transhipper is moored longitudinally between the port 126 and the cargo vessel 125 to serve as a long reach loading bridge between port 126 and the cargo vessel 125. Further, according to this mode of operation, the material is discharged directly from the outward source 126 into the bow hopper 30. Once discharged into the bow hopper 30, the material is transferred to the cargo vessel 125 as described above under the first method of operation.

Figure 9:
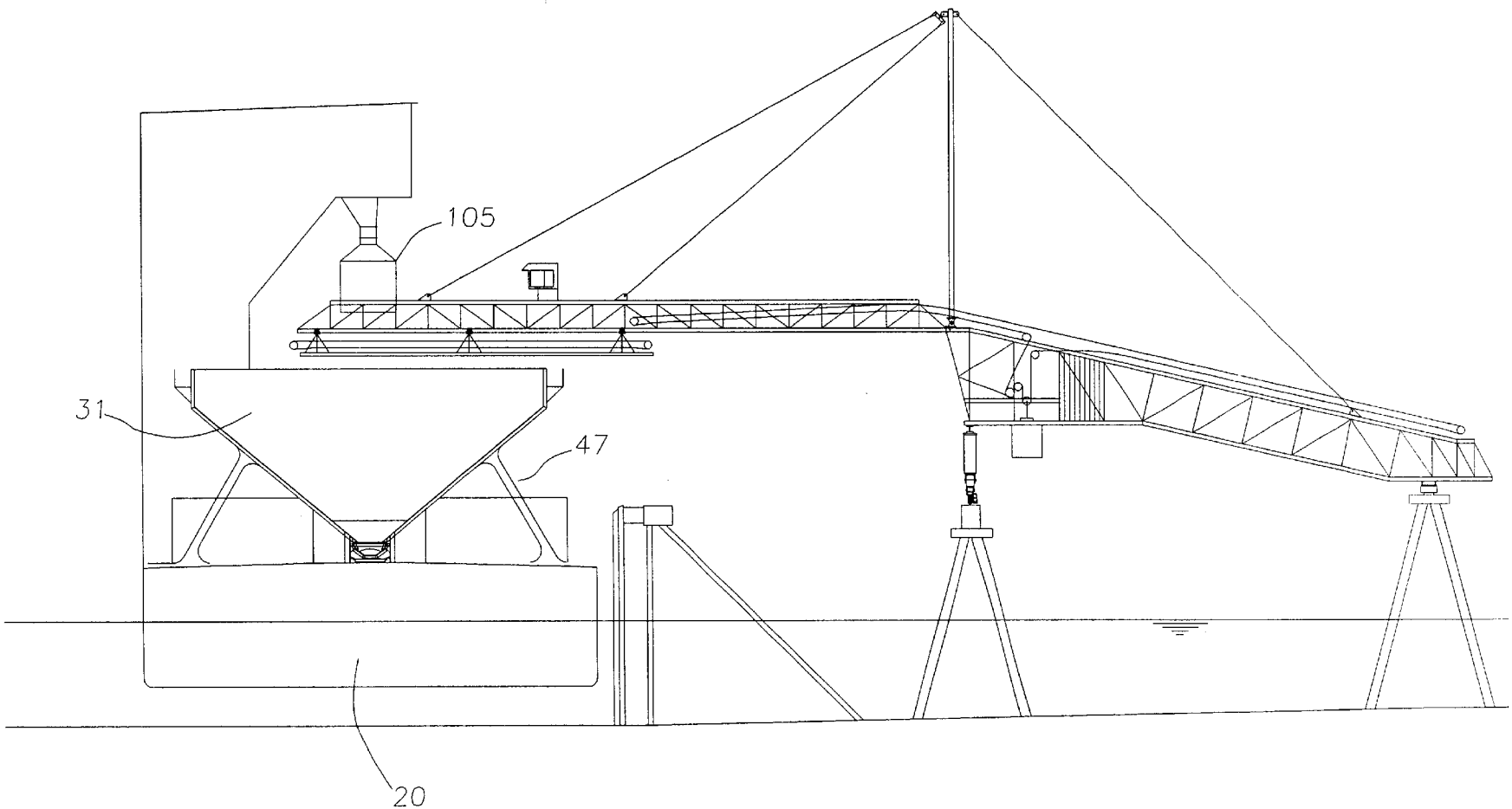
FIG. 9 is a section of the transhipper of FIG. 1 at baseline 170 in FIG. 2 showing a method of material transfer where the transhipper is moored alongside an outward material source which is rigged to transfer material to the transhipper.

In the third method of operation, the material may be loaded onto the transhipper 20 either directly into the main hopper 31 or into the bow hopper 30 as shown in FIG. 9 for self-loading by the transhipper 20 into its main hopper 31 as described below. The transhipper 20 is then towed or propels itself to an outward destination, for example at deep sea, where the transhipper would unload the material from its main hopper 31 into, for example, the cargo hold of a cargo vessel.

According to the third, self-loading method of operation, the material discharged into the bow hopper 30 is conveyed to the boom conveyor 26 and discharged through chute 119 of the boom 89 as described under the first method of operation above. In the third method of operation however, the boom 89 is slewed over the main hopper 31 to allow for a discharge of the material into the main hopper 31. The shuttle 105 of the boom 89 is extended or retracted to allow for an even distribution of the material into the main hopper 31.

According to the third method of operation an alternate and further method of evenly distributing the material to the main hopper 31 is provided by means of the tripper conveyor 27. In this configurations the material is discharged through chute 119 of boom 89 onto the tripper conveyor belt 127. The material is raised by means of a tripper shuttle 128 and discharged through the tripper shuttle chute 129 into the main hopper 31. According to this method, the tripper shuttle 128 may be located above a predetermined hold 48 of the main hopper 31 to allow for a discharge of the material into the hold, When that hold is filled, the tripper shuttle 128 is relocated above the next hold, and so forth. In the case of hold 129 of the main hopper 31, as shown on FIG. 2, hold 129 may be filled by reversing the tripper conveyor belt 127 to discharge the material on the belt 127 through chute 130 into hold 129.

According to the third method of operation, once the transhipper 20 is moored alongside or transversely to the outward destination, for example, a cargo vessel, for the transhipper 20 commences to unload the material in its main hopper 31. The material is discharged from the holds 48, indicated as Hold 1 through 5 in FIG. 2, either individually or in unison onto the reclaim conveyor 24. The flow of the material from the main hopper 31 is induced by gravitational pull when the closure members 57 of a gate 54 are moved into the open position. The rate of flow of the material onto the reclaim conveyor 24 and the volume of material released onto the reclaim conveyor 24 is manipulated as described above.

The material released onto the reclaim conveyor 24 is conveyed and discharged through chute 119 of boom 89 for distribution to the outward destination as described above. When moored alongside the vessel, the boom 89 would be slewed transverse to the transhipper 20 over the cargo hold of the vessel, but when the transhipper 20 is stern moored diagonally to the cargo vessel, the boom 89 would be slewed longitudinally over the stern of the transhipper 20 to allow for a discharge of the material into the cargo hold of the cargo vessel. In accordance with this mode of transfer, the boom 89 is also capable of being luffed relative to the height of the cargo vessel.

Whilst only the preferred embodiments of the invention have been described herein in detail, the invention is not limited thereby and modifications can be made within the scope of the attached claims.

We claim:

1. A transhipper, comprising:

a buoyant vessel;

a bulk material receiving system, supported on the buoyant vessel, to receive bulk material delivered to the transhipper from an outward source, said bulk material receiving system comprising bow hopper means to receive the bulk material delivered to the transhipper from an outward source;

a bulk material holding system supported on the buoyant vessel to hold bulk material received from an outward source for transhipment to an outward destination;

a bulk material distribution system for outward distribution to an outward destination of the bulk material received by the transhipper from an outward source, or held in the bulk material holding system;

said bow hopper comprising a discharge opening and being mounted on the buoyant vessel in a raised position on a number of columns or pillars to allow for the positioning of a loading conveyor means underneath the discharge opening of the bow hopper; and, wherein the bulk material receiving system further comprises said loading conveyor means positioned as described above to receive the bulk material discharged through the discharge opening of the bow hopper.

2. A transhipper, comprising:

a buoyant vessel;

a bulk material receiving system, supported on the buoyant vessel, to receive bulk material delivered to the transhipper from an outward source;

a bulk material holding system supported on the buoyant vessel to hold bulk material received from an outward source for transhipment to an outward destination; and a bulk material distribution system for outward distribution to an outward destination of the bulk material received by the transhipper from an outward source, or held in the bulk material holding system;

wherein the bulk material holding system comprises a main hopper fixedly mounted longitudinally on the buoyant vessel in a raised position on a number of pillars or columns.

3. The transhipper of claim 2 wherein the walls of the main hopper are sloped inward to converge at a discharge opening or a number of discharge openings to allow for the gravity discharge of the bulk material held in the main hopper through the said discharge opening or openings.

4. The transhipper of claim 2 wherein said main hopper comprises one or more discharge openings positioned above a reclaim conveyor means to allow for the discharge of the bulk material from the main hopper onto the said reclaim conveyor means.

5. The transhipper of claim 4 wherein the main hopper is divided into a number of holds, each hold with its own discharge opening or discharge openings to allow for segregation of bulk material into types of bulk material or to allow for an equal distribution of the weight of the bulk material loaded in the main hopper.

6. A transhipper, comprising:

a buoyant vessel;

a bulk material receiving system, supported on the buoyant vessel, to receive bulk material delivered to the transhipper from an outward source;

a bulk material holding system supported on the buoyant vessel to hold bulk material received from an outward source for transhipment to an outward destination; and a bulk material distribution system for outward distribution to an outward destination of the bulk material received by the transhipper from an outward source, or held in the bulk material holding system;

wherein the bulk material distribution system is mounted on said buoyant vessel and comprises:

a reclaim conveyor means for receiving bulk material discharged from the bulk material receiving system or the bulk material holding system for the transfer of the sail bulk material to the bulk material distribution system;

a vertical conveyor means for receiving the bulk material for the reclaim conveyor means and to raise the bulk material to a boom conveyor means for distribution of the bulk material to an outward destination or for discharge of the bulk material into the bulk material holding system; and a distribution conveyor means to receive the bulk material raised by the vertical conveyor means to allow for the distribution of the bulk material to an outward destination or to allow for the discharge of the bulk material into the bulk material holding system.

7. The transhipper of claim 6 wherein the bulk material holding system comprises a main hopper having discharge openings, and wherein said reclaim conveyor means spans the buoyant vessel longitudinally between the bulk material receiving system and the bulk material distribution system, and is suspended from a plurality of support members or columns so that the reclaim conveyor is suspended underneath said discharge openings of said main hopper.

8. The transhipper of claim 7 wherein the reclaim conveyor further comprises a material bearing surface and vertical skirting means laterally defining opposite edges of the material bearing surface of the reclaim conveyor to contain the bulk material on the reclaim conveyor during conveyance of the bulk material to the said bulk material distribution system.

9. The transhipper of claim 6 wherein the distribution conveyor means is a telescopic belt conveyor having a variable effective horizontal length of conveyance.

10. The transhipper of claim 6 wherein the vertical conveyor means is a C-loop conveyor comprising:

two vertically opposed endless belt conveyor means having mutually facing material bearing surfaces for sandwiching or enclosing the bulk material between said respective material bearing surfaces to counteract spillage of the bulk material from the belts during vertical elevation of the bulk material in the vertical conveyor means.

11. The transhipper of claim 10 wherein the C-loop conveyor is encased in a frame fixedly mounted to the buoyant vessel in a position diagonal to the reclaim conveyor.

12. The transhipper of claim 6 wherein the distribution conveyor means comprises:

a support tower; and a telescopic boom having a variable effective horizontal stroke.

13. The transhipper of claim 12 wherein the support tower comprises:

slewing means to allow for the horizontal slewing of the boom from amidship to aft of the transhipper relative to the position of the bulk material destination; and pivoting means to allow for a vertical luffing of the boom relative to the height of the bulk material destination.

14. The transhipper of claim 6 wherein the bulk material holding system further comprises a reversible tripper conveyor longitudinally mounted in a raised position above the main hopper to receive bulk material discharged from the distribution conveyor and to further distribute the bulk material to said respective holds of the main hopper.

15. A transhipper, comprising:

a buoyant vessel;

a bulk material receiving system, supported on the buoyant vessel, to receive bulk material delivered to the transhipper from an outward source, wherein the bulk material receiving system comprises bow hopper means to receive the bulk material delivered to the transhipper from an outward source;

a bulk material holding system supported on the buoyant vessel to hold bulk material received from an outward source for transhipment to an outward destination;

a bulk material distribution system for outward distribution to an outward destination of the bulk material received by the transhipper from an outward source, or held in the bulk material holding system; and, a main hopper fixedly mounted longitudinally on the buoyant vessel in a raised position and wherein the bow hopper and the main hopper have discharge openings and wherein the main hopper of the bulk material holding system and the discharge opening of the bow hopper of the bulk material receiving system each further comprises a gate with a closure member extending across the discharge opening and having a width dimension and a length dimension in the horizontal direction to control the rate of flow and the volume of flow of the bulk material from said hoppers through said discharge openings.

16. The transhipper of claim 15 wherein the gate comprises of two closure members and means for moving the two closure members in reciprocally opposed directions in the horizontal plane.

17. The transhipper of claim 16 further comprising means for moving at least one of the closure members in the horizontal plane independently of the other closure member.

18. The transhipper of claim 16 wherein the gate further comprises guides to define the movement on the horizontal plane of the closure member or closure members.

19. The transhipper of claim 16 further comprising a power source for moving the closure members relative to each other in reciprocally opposed directions or for moving the one closure member independently of the other.

20. The transhipper of claim 16 wherein, each gate further comprises scraper means slidably attached to the main hopper in a vertical position transverse to a material bearing surface of a reclaim conveyor to produce a constant vertical height definition of the bulk material being moved along said reclaim conveyor.

21. The transhipper of claim 20 wherein the scraper means comprises:

a vertical shear plate having a material bearing surface and vertical skirting means laterally defining opposite edges of the material bearing surface of the reclaim conveyor to contain the bulk material on the reclaim conveyor during conveyance of the bulk material to said bulk material distribution system, said vertical shear plate being slidably affixed to the underside of the main hopper in a position transverse to said material bearing surface of the reclaim conveyor to allow for a vertical stroke adjustment of the shear plate relative to said material bearing surface;

tracks to slidably attach said vertical opposite edges of the shear plate to said skirting means to allow for the vertical adjustment of the stroke of the shear plate and to prohibit a lateral movement of the shear plate during operation of the reclaim conveyor; and power means for adjusting the vertical stroke of the shear plate relative to the material bearing surface of the reclaim conveyor.

22. A method of transferring particulate or granular material from an outward bulk material source to an outward bulk material destination comprising the steps of:

recovering bulk material from a selected outward bulk material source by means of a lifting conveyor and discharging the bulk material so recovered into a bow hopper;

discharging the bulk material from the bow hopper onto a reclaim conveyor and discharging the bulk material from the reclaim conveyor onto a vertical conveyor;

discharging the bulk material from the vertical conveyor onto a distribution conveyor for further discharging of the bulk material from the distribution conveyor to an outward bulk material destination; and, further comprising mooring the bow of a transhipper to the outward bulk material source and the stern of the transhipper to the outward bulk material destination, said transhipper comprising said lifting conveyor, said bow hopper, said reclaim conveyor and said distribution conveyor.

23. The method of claim 22 wherein the bulk material source is a cargo vessel, a barge or a port and the outward bulk material destination is a cargo vessel or a barge.

24. A method of transferring particulate or granular material from an outward bulk material source to an outward bulk material destination comprising the steps of:

recovering bulk material from a selected outward bulk material source by means of a lifting conveyor and discharging the bulk material so recovered into a bow hopper;

discharging the bulk material from the bow hopper onto a reclaim conveyor and discharging the bulk material from the reclaim conveyor onto a vertical conveyor;

discharging the bulk material from the vertical conveyor onto a distribution conveyor for further discharging of the bulk material from the distribution conveyor into a storage hopper;

self-propelling and steering of a transhipper to, or the towing of the transhipper to the bulk material destination, said transhipper comprising said lifting conveyor, said bow hopper, said reclaim conveyor and said distribution conveyor;

mooring the transhipper alongside the outward bulk material destination or mooring the transhipper to the outward bulk material destination in a position where the said outward destination is astern of the transhipper, which is moored perpendicular to the outward destination;

slewing the distribution conveyor relative to the position of the outward bulk material destination; and discharging the bulk material from the storage hopper onto the reclaim conveyor further conveying the bulk material with the vertical conveyor and distribution conveyor, as described above for outward distribution of the bulk material to the outward bulk material destination.

* * * * *